United States Patent [19]

Thiele et al.

[11] 4,134,086

[45] Jan. 9, 1979

[54] WAVE GUIDE CONNECTION

[75] Inventors: Paul Thiele, Hanover; Hans Ulrich Bresch, Langenhagen, both of Germany

[73] Assignee: Kabel-und Metallwerke Gutehoffnungshutte Aktiengesellschaft, Hanover, Germany

[21] Appl. No.: 792,725

[22] Filed: May 2, 1977

[30] Foreign Application Priority Data

May 4, 1976 [DE] Fed. Rep. of Germany ..... 2619581

[51] Int. Cl.[2] ..... H01P 5/08; H01P 1/04; H01P 3/12

[52] U.S. Cl. ..... 333/27; 333/21 R; 333/33; 333/98 R

[58] Field of Search ..... 333/98 R, 95 R, 95 A, 333/21 R, 21 A, 27, 33; 29/600

[56] References Cited

U.S. PATENT DOCUMENTS 3,772,772 11/1973 Lehnert ..... 29/600
3,928,825 12/1975 Kaffenberger et al. ..... 333/21 R

FOREIGN PATENT DOCUMENTS 596075 4/1960 Canada ..... 333/33

*Primary Examiner*—Alfred E. Smith
*Assistant Examiner*—Marvin Nussbaum
*Attorney, Agent, or Firm*—Smyth, Pavitt, Siegemund, Jones & Martella

[57] ABSTRACT

Short connection between a hf-gigahertz transmitter and a load with rectangular input is made through an elliptical, corrugated copper tube having inductive and capacitive diaphragms in the transition zone which compensate each other and the characteristic impedance of the wave guide and of the input are at least approximately equal.

2 Claims, 4 Drawing Figures

WAVE GUIDE CONNECTION

BACKGROUND OF THE INVENTION

The present invention relates to wave guide engineering practiced for the purpose of transmitting electromagnetic energy from a transmitter to a receiving apparatus; and more particularly the invention relates to the transition from a wave guide to a rectangular input of the apparatus which is to receive the electro-magnetic energy.

Wave guides are used, for example, for connecting high frequency transmitters to equipment that needs such energy, for example, appropriate heaters. In many such instances only relatively short path lengths have to be bridged so that the lengths of the wave guides are, for example, from two to five meters. If the equipment so supplied with HF energy is a high frequency heater, the wave lengths are in the Gigahertz range. It is common practice to provide the equipment receiving such energy with an input for connection to a wave guide and having a rectangular cross sectional contour. This being almost a standard kind of equipment designed, it is also common practice to use a more or less rigid, rectangular wave guide for connecting the transmitter to the equipment. It was found, however, that such a rectangular wave guide has a significant disadvantage in that it can be used in a simple fashion only in those rare instances where the path to be traversed is on a straight line. Much more common, however, is a situation in which the transmitter output and the equipment input are not on a straight line of sight so that level differences or lateral displacements have to be bridged through appropriately bent portions. The use of rigid wave guides has also the disadvantage that once a connection is made, position changes of the interconnected equipment are no longer possible.

DESCRIPTION OF THE INVENTION

It is an object of the present invention to provide a single piece and flexible wave guide for connection of a transmitter to a piece of user equipment still having a very low reflection and possibly even permitting position changes between the transmitter and the receiving equipment without having to change the connection as such.

In accordance with the preferred embodiment of the present invention, it is suggested to use a flexible, elliptical tubing as a wave guide having a cross section that is matched to the rectangular cross section of the equipment so that the wave guide and the equipment input have the same wave impedance and wherein inductive and capacitive diaphragms are disposed in the transition zone which, in effect, compensate each other.

Flexible, elliptical wave guides are, of course, known per se but the specific utilization in the specific environment suggested here permits the traverse of a large variety of connecting paths without encountering any problems. The flexible elliptical tubing used as wave guide connection is, of course, a single piece. If a corrugated tube is used, such a tube can be bent rather simply wherever a path deflection is needed. In spite of the fact that the cross section of wave guide and equipment differ, it was found that a particular transition part is not necessary. As a surprising result, it was found that a direct connection of wave guide and equipment will still exhibit very little reflection if the characteristic impedances of wave guide and equipment input are equal, and if capacitive and inductive diaphragms compensate as to their effects. Another advantage of the wave guide in accordance with the present invention is to be seen in that it can be made rather simply because all that is needed is a corrugated tube, which can be made from a longitudinally folded and seam welded copper strip. Such a corrugated tube can be reeled on a drum and taken therefrom at the desired length.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a transmitter which transmits high frequency energy; the frequencies being in the gigahertz range from 2.4 to 2.5 GHz. The transmitter 1 transmits this high frequency energy particularly into a wave guide 2 which is assumed to traverse a certain path; that path is not necessarily straight but for reasons of accomodating to existing conditions the wave guide has to undergo deflections in several spaces and places.

The wave guide 2 terminates in a piece of equipment which could be a receiver but is of general nature; the particular details and purpose of this device 3 are immaterial for the present invention. Suffice it to say that the apparatus 3 is to receive the h.f. energy and use it in some fashion. The device 3 has a particular input 4 or inlet opening which has about the same cross sectional area as the wave guide. However, the contours differ, the particular cross section of this input 4 is of a rectangular configuration, while the wave guide is of elliptical cross section.

Figure 1:
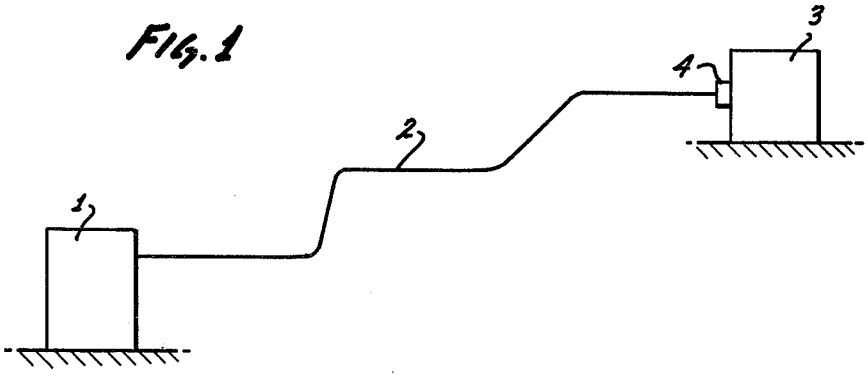
FIG. 1 is a schematic view of a transmitter and a device connected to the transmitter through a wave guide constructed in accordance with the preferred embodiment of the present invention.
Figure 2:
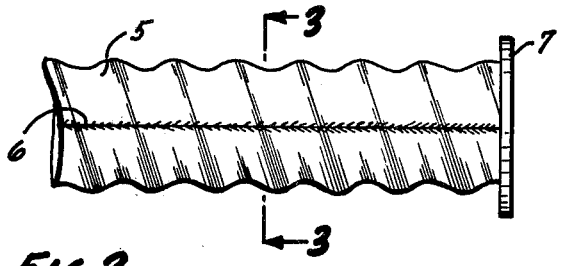
FIG. 2 is a side view of a portion of a wave guide used in this system of FIG. 1.
Figure 3:
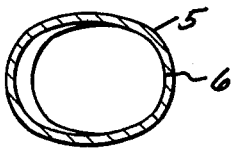
FIG. 3 is a cross section along lines 3—3 in FIG. 2.
Figure 4:
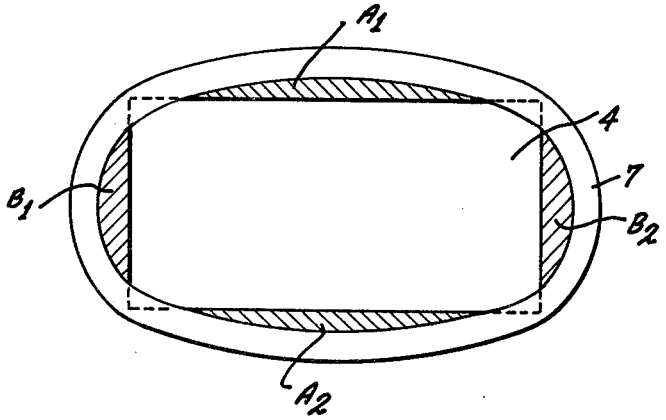
FIG. 4 is still a more enlarged front view of the transition between wave guide and equipment.

The wave guide 2 is constructed from a metallic tube 5 made, for example, of copper. As can be seen from FIG. 2, the tube 5 is corrugated in order to provide the wave guide with a considerable amount of flexibility. Conveniently, this particular tube has been made by longitudinally folding a copper strip; welding the abutting edges and corrugating the resulting tube. Reference 6 refers to the longitudinal welding seam. The particular corrugation extends essentially transversely to the axis of the tube, conveniently the corrugation may be of a helical nature.

The end of tube 5 by means of which the wave guide is to be connected to the apparatus 3 is provided with a flange 7. That flange may have been formed from the tube itself through outwardly extending beading. It is essential that the front end of that flange 7 defines a flat connecting surface by means of which the wave guide as a whole is to be connected to the input of appparatus 3.

The construction and manufacturing of such a wave guide does not offer any difficulties and the making of such a wave guide, as outlined above, is known in the art. As was mentioned earlier, it is a problem to find the proper cross sectional dimensions which insure a transition of the wave conduction to the device 3 with as little reflection as possible.

The range of frequencies to be transmitted as well as the rectangular and length dimensions of the input 4 are known. Furthermore, the characteristic impedance of input 4 is known. Therefore, in accordance with the preferred embodiment of the invention, it is suggested to provide two capacitive diaphragms A1 and A2 and two inductive diaphragms B1 and B2 in such a manner that the former compensate the effect of the latter. On that basis, it is rather simple to calculate the particularly needed cross sectional dimensions of the ellipse which defines the principal cross sectional area of the wave guide.

The particular requirement, that the effect of the capacitive diaphragms is to be compensated by the effect of the inductive diaphragms renders these calculations, particularly simple. These calculations are known per se and will not require elaboration. One will use today an automated computing program for that purpose.

In order to provide for the required minimal reflection in the transition region from elliptical to rectangular cross section as between the wave guide and the device 3; it is required that the cross sectional area of rectangle and ellipse are approximately equal. Accordingly, the capacitive and inductive diaphragms are rather small. In addition, it is necessary that the free corner areas of the rectangular input 4 are fully covered by the flange 7 because it is necessary to avoid the formation of any open slots in the transition and connecting area through which h.f. energy could escape.

The invention is not limited to the embodiments described above but all changes and modifications thereof not constituting departures from the spirit and scope of the invention are intended to be included.

We claim:

1. Wave guide for transmitting electro-magnetic, high-frequency energy from a transmitter to a piece of user equipment having a wave input of rectangular cross section, the wave guide provided for direct connection to the input without interpositioning of a transition member, comprising: a flexible tube of elliptical cross section directly connected to the input thereby defining an abrupt transition zone between rectangle and elliptical cross section establishing diaphragms bounded by curved portions of the tube and straight line portions of the rectangle input, the cross section of the tube matching the cross section of said input so that the characteristic impedance of the wave guide and of the rectangular input are at least approximately equal; and the diaphragms providing inductive and capacitive impedances in the transition zone as between the wave guide and said input which diaphragm impedances compensate each other.

2. Wave guide in accordance with claim 1 wherein said wave guide tube is made of metal being a longitudinally seam welded tube which is corrugated essentially transversely to the longitudinal axis of the wave guide and having a flange around its end periphery to cover residual portions of the input when connected thereto.

* * * * *